US009468931B2

(12) United States Patent
Gross

(10) Patent No.: US 9,468,931 B2
(45) Date of Patent: Oct. 18, 2016

(54) VALVE/MILL ARRANGEMENT

(71) Applicant: Robert Bosch GmbH, Stuttgart (DE)

(72) Inventor: Martin Gross, Steinen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/902,892

(22) PCT Filed: Jun. 24, 2014

(86) PCT No.: PCT/EP2014/063227
§ 371 (c)(1),
(2) Date: Jan. 5, 2016

(87) PCT Pub. No.: WO2015/000737
PCT Pub. Date: Jan. 8, 2015

(65) Prior Publication Data

US 2016/0144374 A1 May 26, 2016

(30) Foreign Application Priority Data

Jul. 5, 2013 (DE) ..... 10 2013 213 246

(51) Int. Cl.
*B02C 18/12* (2006.01)
*B02C 23/10* (2006.01)
(Continued)

(52) U.S. Cl.
CPC ..... *B02C 18/12* (2013.01); *B02C 18/22* (2013.01); *B02C 18/2225* (2013.01); *B02C 23/10* (2013.01); *B02C 2023/165* (2013.01)

(58) Field of Classification Search
CPC ... B02C 18/12; B02C 18/22; B02C 18/2225; B02C 18/0084; B02C 18/0092; B02C 23/10; B02C 2023/165
USPC ..... 241/73, 46.01, 46.013, 46.017
See application file for complete search history.

(56) References Cited

U.S. PATENT DOCUMENTS 2,661,666 A * 12/1953 Knoll ..... D21D 1/32 241/258
2,846,155 A * 8/1958 Higer ..... B02C 18/0092 241/246

(Continued)

FOREIGN PATENT DOCUMENTS

EP 1707270 10/2006
GB 898976 6/1962

OTHER PUBLICATIONS

International Search Report for Application No. PCT/EP2014/063227 dated Sep. 24, 2014 (English Translation, 2 pages).

*Primary Examiner* — Faye Francis
(74) *Attorney, Agent, or Firm* — Michael Best & Friedrich LLP

(57) ABSTRACT

The present invention describes a valve/mill arrangement (1) comprising a valve (2) having a valve housing (11) with an inlet opening (12) and an outlet opening (13), and having a closure element (14) for closing the inlet opening (12). The valve/mill arrangement (1) also comprises a mill (3) having a mill rotor (20) with at least one mill tool (22), having at least one mill screen (23) and having a drive device (24) for driving the mill rotor (20). The mill rotor (20) and the mill screen (23) here are arranged, at least in part, in the valve housing (11), and a travel path of the closure element (14) runs, at least in part, coaxially in relation to an axis of rotation (25) of the mill rotor (20). Unused space in the interior of the valve housing (11) is thus utilized by the mill (3). This means that a compact construction of the valve/mill arrangement (1) is possible.

12 Claims, 4 Drawing Sheets

(51) Int. Cl.
*B02C 18/22* (2006.01)
*B02C 23/16* (2006.01)

(56) References Cited

U.S. PATENT DOCUMENTS 2,951,649 A * 9/1960 Rietz ..... A47J 43/046 125/24
3,049,306 A 8/1962 Nowlin
3,411,721 A * 11/1968 Delcellier ..... D21D 1/36 162/236
3,897,600 A * 8/1975 Burkholder ..... E03F 5/22 210/800
4,029,262 A * 6/1977 Lazich ..... B02C 18/12 241/152.2
4,216,918 A * 8/1980 Kahmann ..... D21B 1/345 209/17
4,225,092 A * 9/1980 Matter ..... B01F 7/16 241/172
4,256,407 A * 3/1981 Seiderman ..... A47J 43/046 241/46.017
4,275,848 A * 6/1981 Webb, Sr. ..... B02C 18/0092 241/165.5
4,607,802 A * 8/1986 Lamort ..... D21B 1/347 241/260.1
4,824,032 A * 4/1989 Johansson ..... B01F 15/0201 241/101.8
5,370,323 A * 12/1994 Narao ..... B30B 9/121 100/117

* cited by examiner

VALVE/MILL ARRANGEMENT

BACKGROUND OF THE INVENTION

The present invention relates to a compact valve/mill arrangement, in which a mill is at least partially integrated into a valve.

In the current process for producing granulates, mills are used to eliminate irregularities in the particle sizes with respect to the maximum grain size and/or to give moist granulates a structure. As a result, follow-up processes can be optimized or made possible. In the case of dry granulates, these follow-up processes include exemplarily grain size reduction for the tableting process; whereas in the case of moist granulates, said processes include grain size reduction in order to dry the moist granulates faster or to give structure to the same for improving the drying, flow and/or metering characteristics thereof. In the prior art, these mills are added on to machines and apparatuses for producing these granulates as ancillary equipment. Because these machines have been developed and built for a closed batch operation, said machines are furnished with closeable discharge and filling openings. Due to the material properties and the process requirements, these apparatuses are constructed and operated such that explosion risks are reduced to a minimum and the effects thereof do not constitute a risk for persons in the proximity of the machine.

The use of these mills enlarges the structural height of the machines as well as the space requirements in general because said mills are equipped with separate carrier devices for pivoting the mill into the operating position thereof or to bring it into a service position.

SUMMARY OF THE INVENTION

The valve/mill arrangement according to the invention has the advantage that a mill is not required as ancillary equipment. According to the invention, the mill is integrated into the valve. The valve/mill arrangement comprises a valve having a valve housing with an inlet opening and an outlet opening, and having a closure element for closing the inlet opening. The valve/mill arrangement also comprises a mill having a mill rotor with at least one mill tool, having at least one mill screen and having a drive device for driving the mill rotor. In so doing, the mill rotor and the mill screen here are arranged, at least in part, in the valve housing, and a travel path of the closure element runs, at least in part, coaxially in relation to an axis of rotation of the mill rotor. Unused space in the interior of the valve housing is thus utilized by the mill. This means that a compact construction of the valve/mill arrangement is possible. A cost saving production can thus be achieved by material savings due to the integration of mill and valve, and the dimensions of a unit comprising the valve/mill arrangement are minimized. The mill tool is preferably a cutting element or a scraping element.

In one preferred embodiment of the invention, the valve/mill arrangement is characterized in that the at least one mill tool is rotatably arranged and defines a rotation chamber, wherein the travel path of the closure element runs inside the rotation chamber. By this otherwise unused space being utilized by the closure element, a particularly compact construction is made possible. In particular, the mill tool or, respectively, the mill rotor can be operated at different uniform or non-uniform speeds forwards or backwards or in an oscillating manner.

In a further preferred embodiment of the invention, the entire travel path runs coaxially in relation to an axis of rotation of the mill rotor. In this way, possible collisions of the closure element with the mill tools can be easily prevented.

It is likewise advantageous if the axis of rotation of the mill rotor is aligned coaxially in relation to the inlet opening. A maximum material feed into the mill is achieved with such an alignment.

In a further advantageous embodiment, a discharge housing is installed at the outlet opening of the valve housing. The discharge housing facilitates a discharge of the milled material which is guided laterally to perpendicularly downward and in a closed manner. The material flow is optimized by the selection of advantageous angles and a stagnating of the material discharge is prevented and, for example, a pneumatic removal of the milled product is made possible.

It is furthermore advantageous if the mill screen is integrated into the valve housing. This results in a further reduction in size of the valve/mill arrangement. In a simple manner, this additionally prevents people from reaching into the operating mill or valve. It is furthermore advantageous if the mill screen extends around the axis of rotation in a range from 15°-360° of the circumference of the valve housing.

An embodiment in which the mill rotor is completely disposed in the valve housing is furthermore preferred. In this way, a maximum saving of space is achieved.

In an embodiment of the valve/mill arrangement that is likewise advantageous, the outlet opening is disposed laterally on the valve housing. This facilitates a simplified, lateral removal of the mill charge.

It is furthermore advantageous to dispose the drive device coaxially in relation to the axis of rotation of the mill rotor. In this way, an optimal force transmission by the drive device onto the mill rotor can be achieved.

In a further preferred embodiment, the drive device is a ring motor having a ring-shaped stator and a ring-shaped rotor, wherein the travel path of the closure element runs through the center of the ring motor.

The valve/mill arrangement can particularly be characterized in that the arrangement further comprises a cleaning nozzle for cleaning the mill screen and the valve. This enables the valve/mill arrangement to be automatically cleaned, whereby manual cleaning steps are reduced or omitted in order inter alia to prevent contamination and whereby the disposability of the arrangement is increased.

It is also advantageous to install the mill screen so as to be replaceable. In so doing, a simple replacement of the screens is possible such that different types of screens for different product and process requirements can be used. This screens can be provided with a coding system for automatically identifying the type which is called for. The replaceability of the mill screen likewise facilitates a simple access and reliable access to the mill's interior in order to rectify malfunctions or perform service activities. This leads to a greater disposability of the valve/mill arrangement because the time required for service activities is reduced.

It is furthermore expedient to dispose the mill tool so as to be replaceable. In so doing, a simple replacement of the mill tools is possible such that different mill tools can be used for different product and process requirements. The mill tools can be provided with a coding system for automatically identifying the type which is called for. The replaceability of the mill tools likewise facilitates a simple rectification of malfunctions and an option to perform service activities. This too leads to a greater disposability of the valve/mill arrangement.

In addition, it is expedient to dispose the mill tools and/or other components of the mill rotor, e.g. the holding fixtures thereof, in such a way that they abut at least in a subarea thereof against or almost against the valve housing, the mill screen and/or the closure element; thus enabling these surfaces to be cleaned of product deposits during movement of the mill tools and/or other components. This furthermore produces a guidance of the mill tools and thus prevents an imbalance.

The axis of rotation of the mill rotor can particularly be arranged vertically. In so doing, an imbalance during the milling process is reduced because the material to be milled presses uniformly against the cutting elements, and a feed of the material to be milled can be simplified. An arrangement of the axis of rotation of the mill rotor at all angles from vertical to horizontal can be advantageous because such an arrangement facilitates an adaption of the valve/mill arrangement to an installation environment.

It is furthermore advantageous to flange-mount the valve/mill arrangement to a machine housing that feeds the material or to provide a housing of the valve/mill arrangement that is integrated with the machine housing.

BRIEF DESCRIPTION OF THE DRAWINGS

Exemplary embodiments of the invention are described below in detail with reference to the accompanying drawings. In the exemplary embodiments, identical or functionally identical components are denoted with the same reference signs. In the drawings.

DETAILED DESCRIPTION

Figure 1:
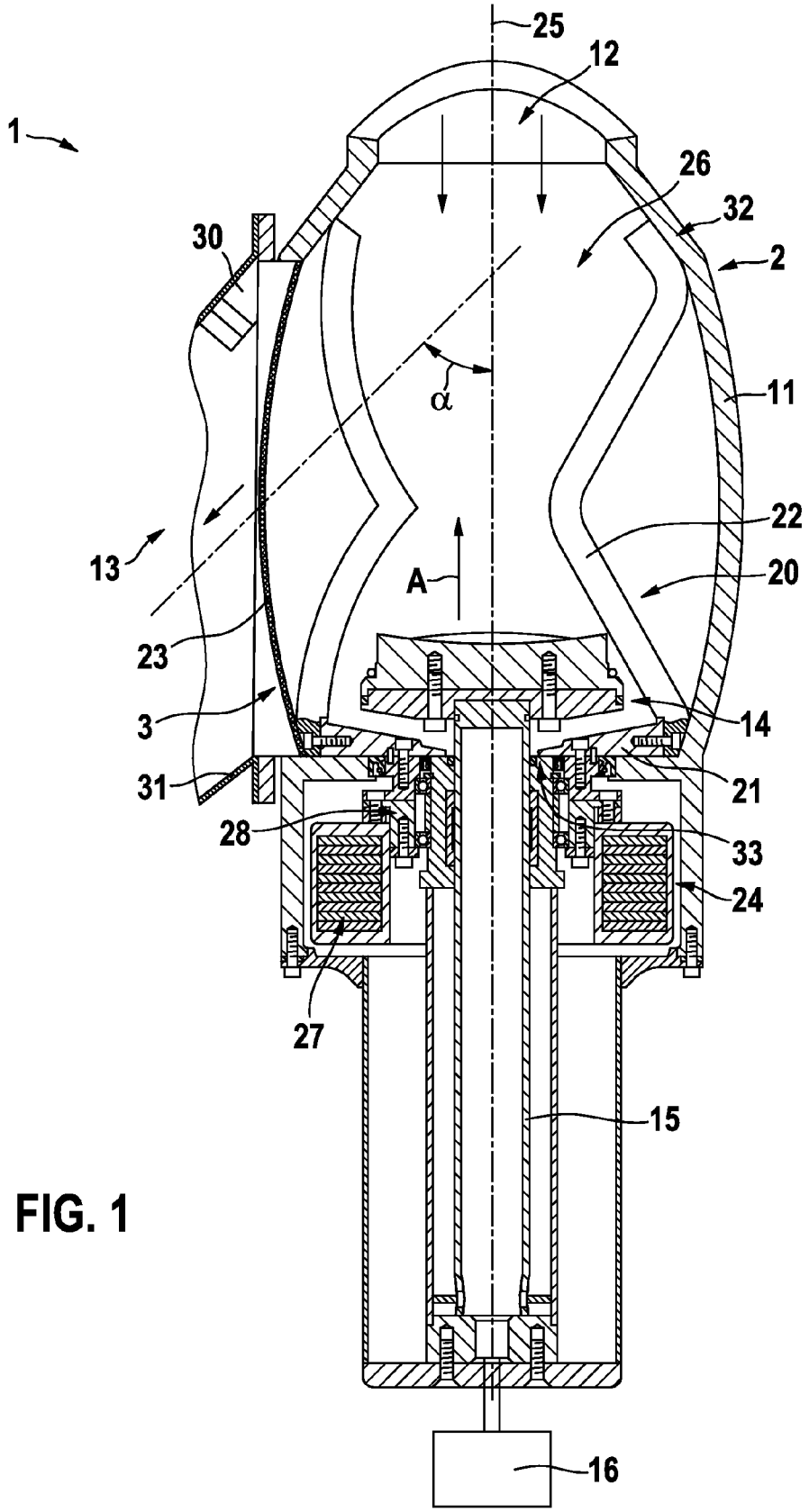
FIG. 1 shows a schematic cross section through a valve/mill arrangement according to a first exemplary embodiment of the invention.

FIG. 1 shows a schematic cross section through a valve/mill arrangement 1 according to a first exemplary embodiment of the invention. The valve/mill arrangement 1 comprises at least one valve 2 and a mill 3.

In this exemplary embodiment, the valve 2 comprises a barrel shaped valve housing 11 having an inlet opening 12 on top and an outlet opening 13 positioned laterally as well as a closure element 14. The closure element 14 comprises a piston 15 and is suitable for closing the inlet opening 12. The piston 15 can be moved along the longitudinal axis thereof and is driven by a valve drive 16. The valve drive 16 relates to any driving means for generating a linear movement, such as, e.g., an actuator, a linear motor or also a pneumatic or hydraulic drive.

The mill 3 comprises a mill rotor 20, a mill screen 23 and a drive device 24. The mill rotor 20 comprises two mill tools 22 and a base part 21. The mill tools 22 are formed in such a way that they abut against the valve housing 11 over their entire length. The cross-sectional profile of the mill tools 22 can have different forms. A round, oval, angular or undercut profile is expedient. Nevertheless, other profiles are also conceivable. The shape of the mill tools 22 in the axial direction thereof is U-shaped in this embodiment (mill tool 22 on the right in FIG. 1) and V-shaped (mill tool 22 on the left in FIG. 1). Even if it is not shown in this exemplary embodiment, any combination of differently shaped mill tools of a valve/mill arrangement 1 according to the invention is possible; however, the use of mill tools 22 of the same construction is advantageous here. Thus, all mill tools 22 of a valve/mill arrangement 1 can, e.g., be U-shaped or V-shaped.

The two mill tools 22 are mounted on the base part 21. The base part 21 is a part of the mill rotor 20, is rotatably mounted and offers an option for the releasable attachment of the mill tools 22. As a result, a simple installation and removal of the mill tools 22 is possible.

An axis of rotation 25 of the mill rotor 20 is aligned coaxially in relation to the inlet opening 12. The mill screen 23 is integrated into the valve housing 111, wherein the mill screen 23 is adapted to the barrel shape of the valve housing 11 proposed in this embodiment. The mill tools 22 abut in the corresponding rotational position at least on a portion of the length thereof against the mill screen 23. In addition, the mill tools 22 abut in at least one subarea 32 against an inside wall of the valve housing, and the base part 21 abuts in another subarea 33 against the adjacent surfaces of the piston 15 and against the inside wall of the valve housing. These components of the mill rotor abut against these surfaces in such a way that a gap is between the components of the mill rotor 20 and the inside wall of the valve housing 11 or the surface of the closure element 14 in order to prevent contact between rotating and static parts.

The mill rotor 20 is driven by the drive device 24 which is disposed coaxially in relation to the axis of rotation 25 of the mill rotor 20. In this embodiment, the drive device is a ring motor having a ring-shaped stator 27 and a ring-shaped rotor 28. Even if an electrically driven motor was selected for this exemplary embodiment, other drive devices, such as, e.g., a pneumatic or a hydraulic drive are conceivable.

In order to close the valve 2, the closure element 14 is moved coaxially in relation to the axis of rotation 25 of the mill rotor 20 in the direction of arrow A until said closure element 14 closes the inlet opening 12. Said closure element 14 thereby traverses a travel path. In so doing, the closure element 12 moves through a rotation chamber 26 which lies between the two mill tools 22. The mill tools 22 are shaped in such a way that a collision cannot occur at any point in time between the closure element 14 and the mill tools 22. In order to open the valve, the closure element 14 is moved back into the initial positon shown in FIG. 1. The piston 15 of the closure element 14 and therefore the travel path of said closure element 14 runs through the ring-shaped stator 27 of the ring motor.

A cleaning nozzle 30 is used to clean the mill screen 23. To this end, air and/or liquid is/are blown or sprayed through the nozzle onto the mill screen.

A discharge housing 31 is mounted laterally at the outlet opening 13. The discharge housing 31 can relate, e.g., to a channel or a tube, which allows for milled material to be collected and to slide away. The discharge housing 31 is mounted on the valve housing 11 at an angle ($\alpha$) in relation to the axis of rotation 25. The angle ($\alpha$) is 45° in this exemplary embodiment.

Figure 2:
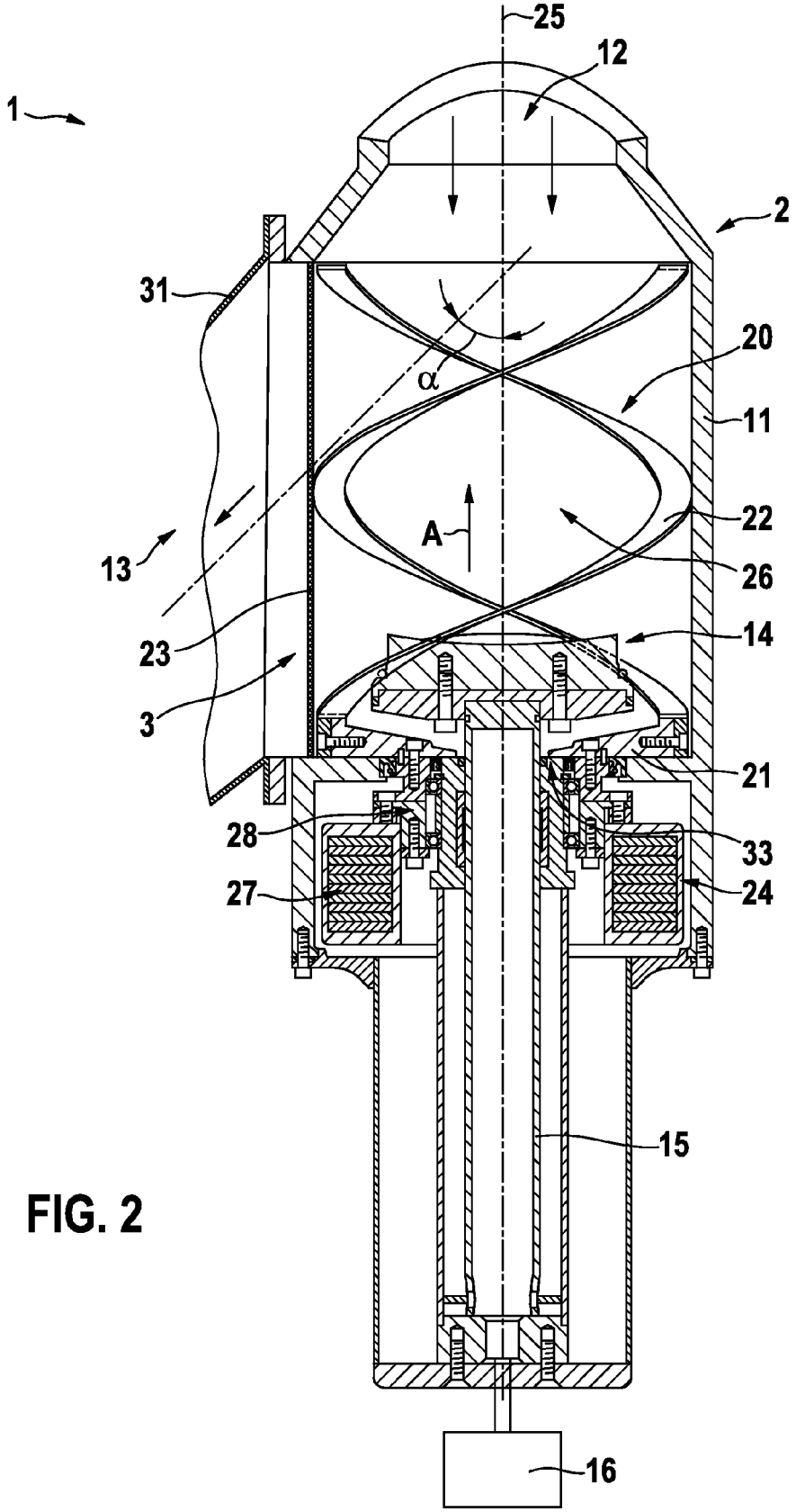
FIG. 2 shows a schematic cross section through a valve/mill arrangement according to a second exemplary embodiment of the invention.

FIG. 2 shows a schematic cross section through a valve/mill arrangement 1 according to a second exemplary embodiment of the invention. The second exemplary embodiment corresponds in the essential features thereof to those of the first exemplary embodiment; however, this exemplary embodiment shows an alternative form of the mill tools 22. The mill tools 22 are wound in the form of a helix about the rotation zone 26 of the mill rotor 20. In addition, the valve housing 11 is cylindrically shaped. The mill screen 23 is designed as a partial cylinder.

Figure 3:
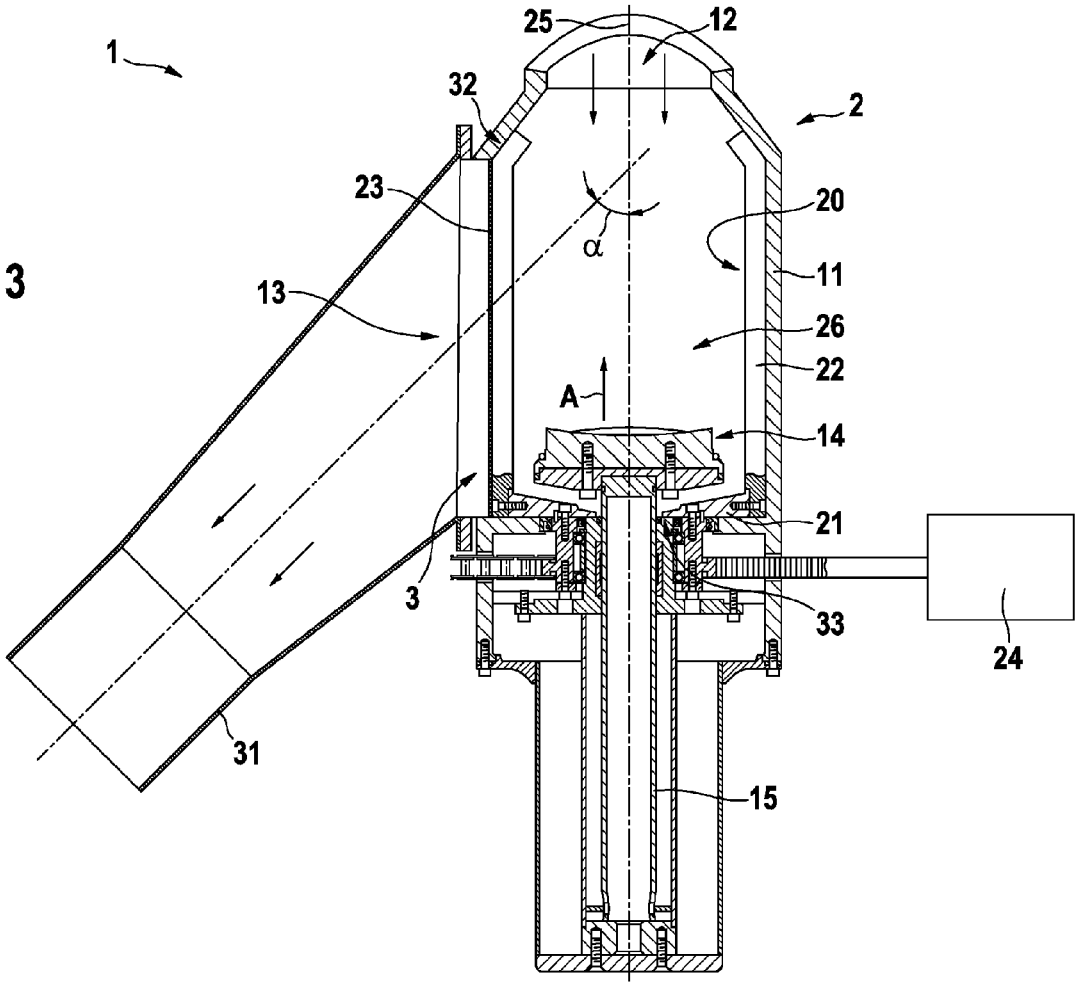
FIG. 3 shows a schematic cross section through a valve/mill arrangement according to a third exemplary embodiment of the invention in a first axis.
Figure 4:
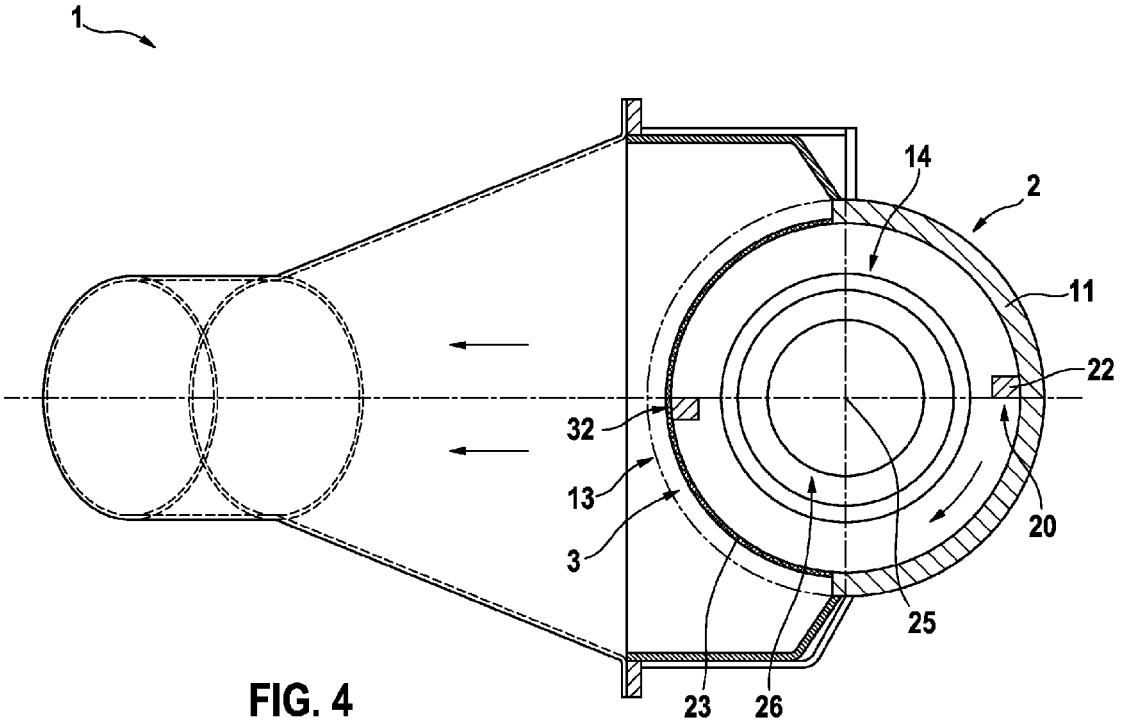
FIG. 4 shows a schematic cross section through a valve/mill arrangement according to the third exemplary embodiment of the invention in a second axis.

FIGS. 3 and 4 show a valve/mill arrangement 1 according to a third exemplary embodiment of the invention. The third exemplary embodiment corresponds in the essential features thereof to those of the second exemplary embodiment. This exemplary embodiment shows a further advantageous form of the mill tools 22. Said mill tools lie in a straight line on the inside of the valve housing 11. In addition, this exemplary embodiment shows an alternative mounting of the drive device 24. In this case, the drive device 24 is not disposed coaxially in relation to the axis of rotation 25 of the mill rotor 20. The driving force is transmitted by means of a belt or a chain to the mill rotor 20. In a similar form, the driving force is transmitted by means of gear wheels or a gearbox.

FIG. 4 shows a schematic cross section through a valve/mill arrangement according to the third exemplary embodiment of the invention. It can be seen here that the mill tools 22 abut against the valve housing 11 or, respectively, the integrated mill screen 23 in each rotational position.

The invention claimed is:

1. A valve/mill arrangement (1), comprising
- a valve (2) having
  - a valve housing (11) with an inlet opening (12) and an outlet opening (13); and
  - a closure element (14) for closing the inlet opening (12); and
- a mill (3) having
  - a mill rotor (20) with at least one mill tool (22);
  - at least one mill screen (23); and
  - a drive device (24) for driving the mill rotor (20);
- wherein the mill rotor (20) and the mill screen (23) are arranged, at least in part, in the valve housing (11); and
- wherein a travel path of the closure element (14) runs, at least in part, coaxially in relation to an axis of rotation (25) of the mill rotor (20).

2. The valve/mill arrangement according to claim 1, characterized in that the at least one mill tool (22) is rotatably arranged and defines a rotation chamber (26), wherein the travel path of the closure element (14) runs in an interior of the rotation chamber (26).

3. The valve/mill arrangement according to claim 1, characterized in that the entire travel path runs coaxially in relation to an axis of rotation (25) of the mill rotor (20).

4. The valve/mill arrangement according to claim 1, characterized in that an axis of rotation (25) of the mill rotor is aligned coaxially in relation to the inlet opening (12).

5. The valve/mill arrangement according to claim 1, characterized in that a discharge housing is mounted at the outlet opening (13) of the valve housing (11).

6. The valve/mill arrangement according to claim 1, characterized in that the mill screen (23) is integrated into the valve housing (11).

7. The valve/mill arrangement according to claim 6, characterized in that the mill rotor (20) is disposed completely in the valve housing (11).

8. The valve/mill arrangement according to claim 1, characterized in that the outlet opening (13) is arranged laterally on the valve housing.

9. The valve/mill arrangement according to claim 1, characterized in that the drive device (24) is disposed coaxially in relation to an axis of rotation (25) of the mill rotor (20).

10. The valve/mill arrangement according to claim 1, characterized in that the drive device (24) is a ring motor having a ring-shaped stator (27) and a ring-shaped rotor (28), wherein the travel path of the closure element (14) runs through the ring-shaped stator (27) of the ring motor.

11. The valve/mill arrangement according to claim 1, characterized in that the arrangement further comprises a cleaning nozzle (30) for cleaning at least one of the mill screen (23) and the valve, and at least one of the mill screen and the mill tool (22) is/are replaceable.

12. The valve/mill arrangement according to claim 1, characterized in that the mill rotor (20) is disposed completely in the valve housing (11).

* * * * *